US010211558B1

(12) United States Patent
Didonato et al.

(10) Patent No.: US 10,211,558 B1
(45) Date of Patent: Feb. 19, 2019

(54) LOW INSERTION FORCE TAB RECEPTACLE

(71) Applicant: TE CONNECTIVITY CORPORATION, Berwyn, PA (US)

(72) Inventors: Michael Edward Didonato, Harrisburg, PA (US); Richard B. Emenheiser, Mount Joy, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/850,648

(22) Filed: Dec. 21, 2017

(51) Int. Cl.
*H01R 11/22* (2006.01)
*H01R 13/115* (2006.01)
*H01R 4/18* (2006.01)
*H01R 13/432* (2006.01)

(52) U.S. Cl.
CPC ..... *H01R 13/115* (2013.01); *H01R 4/185* (2013.01); *H01R 11/22* (2013.01); *H01R 13/432* (2013.01)

(58) Field of Classification Search
CPC ... H01R 13/115; H01R 13/111; H01R 13/113; H01R 4/185
USPC ..... 439/849–852, 865, 877
See application file for complete search history.

(56) References Cited

U.S. PATENT DOCUMENTS 2,774,951 A * 12/1956 Hammell ..... H01R 11/22 439/849
2,921,287 A * 1/1960 Anderson ..... H01R 13/115 439/849
3,086,193 A 4/1963 Berg
3,546,663 A * 12/1970 Holmberg, Jr. ..... H01R 13/20 439/849
3,550,069 A * 12/1970 Teagno ..... H01R 13/115 439/849
3,633,156 A 1/1972 Teagno
4,220,388 A * 9/1980 Dechelette ..... H01R 13/115 439/268
4,423,921 A * 1/1984 Hall ..... H01R 13/115 439/849

(Continued)

FOREIGN PATENT DOCUMENTS

GB 2189090 A 10/1987

OTHER PUBLICATIONS 4.8 MM (.187) Series Faston Receptacles, 4 pgs, Feb. 2017.

(Continued)

*Primary Examiner* — Thanh Tam Le

(57) ABSTRACT

A receptacle terminal for receipt of a mating terminal therein. The receptacle terminal has a contact portion including a bottom wall and resilient contact arms which extend from the bottom wall. The resilient contact arms have resilient contact sections and mating terminal engagement members. The mating terminal engagement members have a projection receiving opening. A spring arm extends from the bottom wall toward the mating terminal engagement members. The spring arm has a projection which extends from the spring arm to create a raised area on an inner surface of the spring arm to engage the mating terminal. Prior to the receipt of the mating terminal, the projection of the spring arm is positioned in the projection receiving opening of the mating terminal engagement members, allowing the portions of the spring arm to be positioned proximate the mating terminal engagement members.

20 Claims, 3 Drawing Sheets

(56) References Cited

U.S. PATENT DOCUMENTS

| | | | | |
|---|---|---|---|---|
| 4,534,613 | A * | 8/1985 | Esser | H01R 13/20 439/834 |
| 6,039,615 | A * | 3/2000 | Suzuki | H01R 13/113 439/849 |
| 7,198,526 | B1 | 4/2007 | MacNeil et al. | |
| 7,255,614 | B1 * | 8/2007 | Irish | H01R 13/113 439/849 |

OTHER PUBLICATIONS

F-Spring Contact Faston Terminal, Improving Connector Reliability and Safety, 5 pgs, 2015.
Product Information for Positive Lock Receptacles, TE Connectivity, Catalog 82004, Mar. 2011, pp. 75-88.

* cited by examiner

LOW INSERTION FORCE TAB RECEPTACLE

FIELD OF THE INVENTION

The present invention is directed to an electrical terminal with a low insertion force. In particular, the invention is directed to a tab receptacle which provides sufficient clearance for the insertion of the tab while providing sufficient normal force to maintain the electrical connection between the tab receptacle and the tab.

BACKGROUND OF THE INVENTION

Socket terminals, such as tab receptacle terminals, which are adapted for quick make and break connections with a mating terminal or mating tab, are known. Terminals of this kind are used to make an electrical connection to a male or tab terminal which is inserted and frictionally held in the socket terminal. Socket terminals of this type are shown in U.S. Pat. No. 3,086,193 and co-pending U.S. patent application Ser. No. 15/203,204, the latter of which is incorporated herein by reference in its entirety.

It is often necessary to disconnect and reconnect such terminals a number of times, for example, for testing purposes prior to final inspection and shipment of the product on which such terminals are used. It is also required that the connection made with such terminals be maintained under conditions of vibration and possible strain in subsequent service. Traditionally, these terminals have been configured to provide a normal force to establish a stable mechanical and electrical connection between the mating tab and the tab receptacle terminal. However, due to the configuration of the tab receptacle terminal, such tab receptacle terminals often have undesirable high insertion forces. In addition, the spring members of the tab receptacle terminals may yield when mating occurs, causing the mechanical and electrical connection to fail.

It would, therefore, be beneficial to provide a tab receptacle terminal which provides sufficient normal force while providing spring members with sufficient beam length to prevent yielding. It would also be beneficial to provide a tab receptacle terminal which provides sufficient clearance for the insertion of the tab while providing sufficient normal force to maintain the electrical connection between the tab receptacle terminal and the mating tab.

SUMMARY OF THE INVENTION

An object is to provide a socket type terminal or tab receptacle terminal which provides sufficient normal force while providing spring members with sufficient beam length to prevent yielding.

An object is to provide a socket type terminal or tab receptacle terminal which provides sufficient clearance for the insertion of the tab while providing sufficient normal force to maintain the electrical connection between the tab receptacle terminal and the mating tab.

An object is to provide a socket type terminal or tab receptacle terminal which provides a stable electrical connection while allowing for a lower insertion force of the mating terminal into the socket terminal.

An embodiment is directed to a receptacle terminal for receipt of a mating terminal therein. The receptacle terminal has a contact portion including a bottom wall and resilient contact arms which extend from the bottom wall. The resilient contact arms have resilient contact sections and mating terminal engagement members. The mating terminal engagement members form a projection receiving opening. A spring arm extends from the bottom wall toward the mating terminal engagement members. The spring arm has a projection which extends from the spring arm to create a raised area on an inner surface of the spring arm to engage the mating terminal. Prior to the receipt of the mating terminal, the projection of the spring arm is positioned in the projection receiving opening of the mating terminal engagement members, allowing the portions of the spring arm to be positioned proximate the mating terminal engagement members.

An embodiment is directed to a receptacle terminal for receipt of a mating terminal therein, the receptacle terminal includes a bottom wall and resilient contact arms which extend from opposed sides of the bottom wall. The resilient contact arms have resilient contact sections and mating terminal engagement members. End surfaces of the mating terminal engagement members have recesses which extend from the end surfaces toward respective resilient contact sections of the resilient contact arms. The recesses are aligned to form a projection receiving opening. A spring arm extends from the bottom wall toward the mating terminal engagement members, the spring arm has a projection which extends from the spring arm to create a raised area on an inner surface of the spring arm to engage the mating terminal. Prior to the receipt of the mating terminal, the projection of the spring arm is positioned in the projection receiving opening of the mating terminal engagement members, allowing the portions of the spring arm to be positioned proximate the mating terminal engagement members.

An embodiment is directed to a receptacle terminal for receipt of a mating terminal therein, the receptacle terminal includes a bottom wall and resilient contact arms which extend from opposed sides of the bottom wall. The resilient contact arms have resilient contact sections and mating terminal engagement members. Openings extend through the resilient contact arms, with first resilient contact sections of the resilient contact sections and second resilient contact section of the resilient contact sections extending on either side of the openings. End surfaces of the mating terminal engagement members have recesses which extend from the end surfaces toward respective resilient contact sections of the resilient contact arms. The recesses are aligned to form a projection receiving opening. The mating terminal engaging members extend from the resilient contact sections toward the bottom wall. Mating terminal engagement surfaces of the mating terminal engaging members are positioned at a top of a mating slot of the receptacle terminal. A spring arm extends from the bottom wall toward the mating terminal engagement members. The spring arm has a projection which extends from the spring arm to create a raised area on an inner surface of the spring arm to engage the mating terminal. Prior to the receipt of the mating terminal, the projection of the spring arm is positioned in the projection receiving opening of the mating terminal engagement members, allowing the portions of the spring arm to be positioned proximate the mating terminal engagement members.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
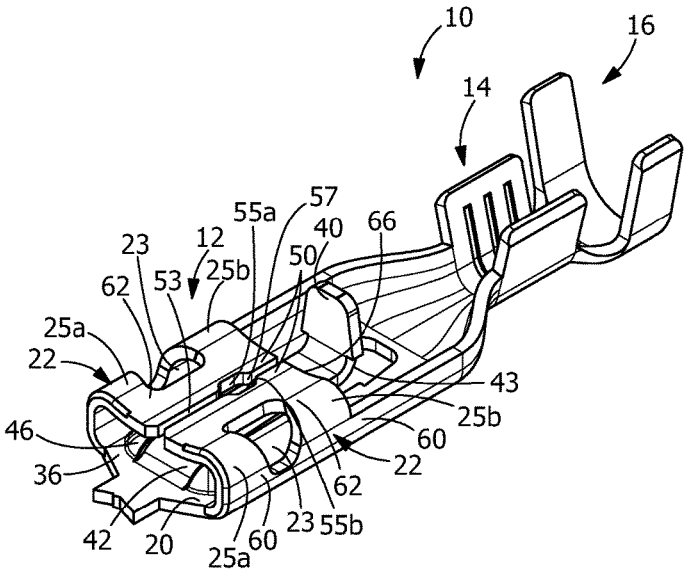
FIG. 1 is perspective view of an illustrative embodiment of the terminal according to the present invention.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features; the scope of the invention being defined by the claims appended hereto.

As best shown in FIGS. 1 through 4, a receptacle, socket or female terminal 10 includes a contact portion 12, a wire barrel 14 behind the contact portion 12 and an insulation barrel 16 behind the wire barrel 14. The wire barrel 14 is configured for crimped connection with an end of a conductive core of an insulated wire. The insulation barrel 16 is configured for crimped connection with an end of the insulation coating or jacket of the wire. Although a wire barrel 14 and an insulation barrel 16 are shown, the contact portion 12 can be used with other types of termination members without departing from the scope of the invention. In the illustrative embodiment shown, the terminal 10 is stamped and formed from a metal plate having a good electrical conductivity.

Figure 5:
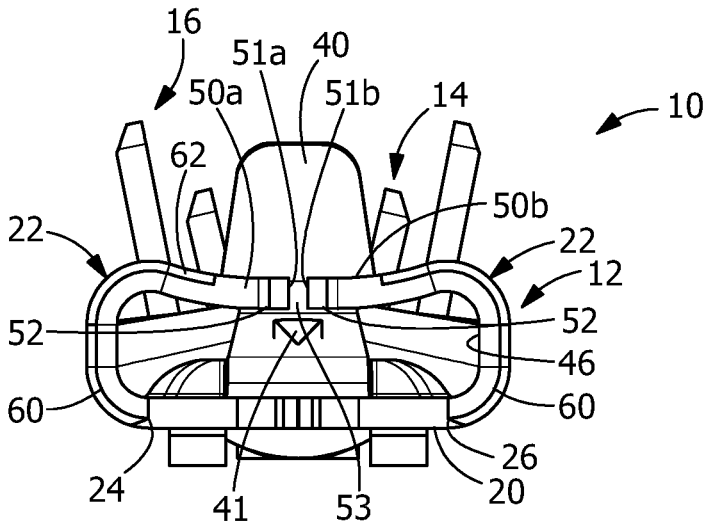
FIG. 5 is a front view of the terminal of FIG. 1.
Figure 6:
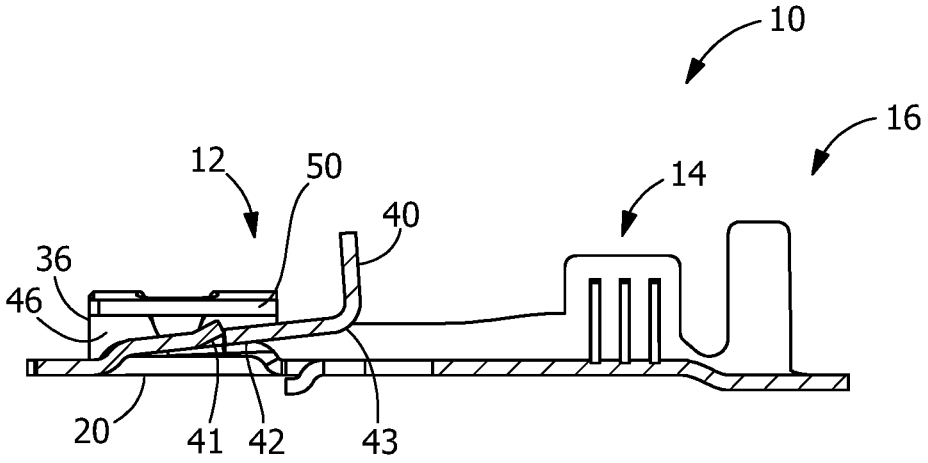
FIG. 6 is a cross-sectional view of the terminal of FIG. 2, taken along line 6-6.

Referring to FIGS. 1, 5 and 6, the contact portion 12 includes a bottom wall 20 and resilient contact arms 22 which extend from either side 24, 26 of the bottom wall 20. As best shown in FIG. 6, the bottom wall 20 has a spring arm 42 provided thereon. The spring arm 42 is stamped and formed from the bottom wall 20.

The spring arm 42 extends from the bottom wall 20 to create a raised portion or arm extending from the inner surface of the bottom wall 20 toward the resilient arms 22. The spring arm 42 includes a projection or embossment, such as, but not limited to, a projection, detent, dimple or lance 41 (as best shown in FIG. 6) which is formed from the spring arm 42 to create a raised area on an inner surface of the spring arm 42. The lance or projection 41 engages the mating terminal as the mating terminal is inserted into the terminal 10, as will be more fully described below.

In the illustrative embodiment shown, each resilient arm 22 has an opening or cutout 23 with a first resilient contact section 25*a* and a second resilient contact section 25*b* extending on either side of the opening 23. The first resilient contact section 25*a* is positioned proximate a mating end 36 of the contact portion 12. The second resilient contact section 25*b* is removed from the mating end 36 toward the wire barrel 14. The openings extend between and separate the resilient contact sections 25*a*, 25*b*. In the embodiment shown, the openings 23 are formed by removing material from a blank prior to forming the terminal. The material removed can be reused in the manufacture of additional terminals. Other methods for forming the openings 23 may be used without departing from the scope of the invention.

As best shown in FIG. 5, the resilient arms 22, including the resilient contact sections 25*a*, 25*b*, have arcuate or curled portions which extend from the bottom wall 20 to a mating terminal engaging member 50. In one illustrative embodiment, one or all of the resilient contact sections 25*a*, 25*b* may have a tapered or trapezoidal configuration, whereby the width of the respective arm at the root or base 60 (FIG. 3), which connects to bottom wall 20, is greater than the width of portion 62 (FIG. 3) of the respective arm proximate the mating terminal engaging member 50. However, other configurations can be used. The configuration of each respective contact section 25*a*, 25*b* of the resilient contact arms 22 allows the stiffness and spring rate of each respective resilient contact section 25*a*, 25*b* and the resilient contact arms 22 to be controlled. A wider root or base 60 allows for a higher spring rate and for a more even distribution of forces from the respective resilient contact sections 25*a*, 25*b* to the bottom wall 20. Conversely, the more narrow the respective resilient contact sections 25*a*, 25*b*, the lower the spring rate of the arm and the lower the effective spring rate of the resilient contact arms 22. Consequently, the respective resilient contact sections 25*a*, 25*b* may each be configured to generate a different contact force, resulting in different contact forces for the resilient contact arms 22.

In various illustrative embodiments, resilient contact sections 25*b* have a back surface or edge 66 which extends in a direction which is essentially perpendicular to the longitudinal axis of the terminal 10. This provides a reference surface which can be used when positioning the terminal 10 in a housing or when mating the mating terminal to the terminal 10.

The mating terminal engagement members 50 of the resilient contact arms 22 extend from the resilient contact sections 25*a*, 25*b* and span opening 23. A mating terminal engagement surface 52 is provided on each mating terminal engaging member 50. In the embodiment shown, the mating terminal engaging member 50 extends from the resilient contact arms 22, positioning the mating terminal engagement surface 52 at the top of a terminal mating slot 46. The configuration of the resilient contact arms 22 provide the resiliency needed to allow the mating terminal engaging member 50 to move relative to the bottom wall 20 as the mating terminal is inserted into the slot 46. As best shown in FIG. 5, the mating terminal engagement surfaces 52 have an arcuate or rounded configuration. However, other configurations of the engagement surfaces 52 may be used.

Figure 2:
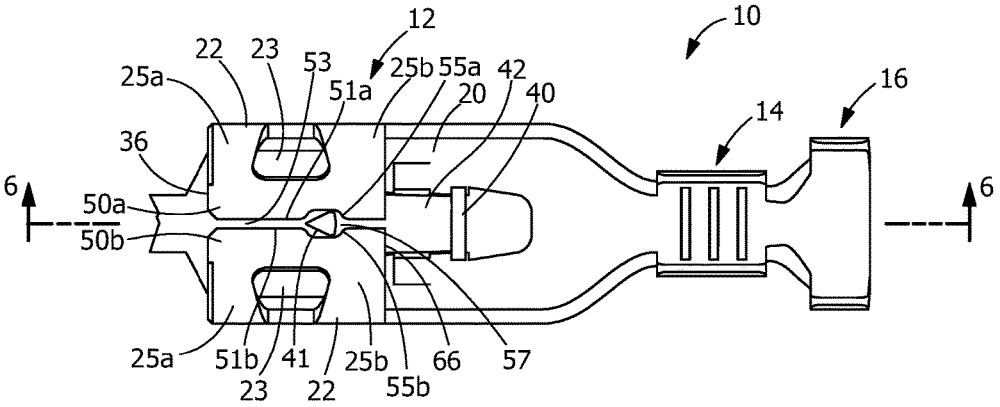
FIG. 2 is a top view of the terminal of FIG. 1.
Figure 3:
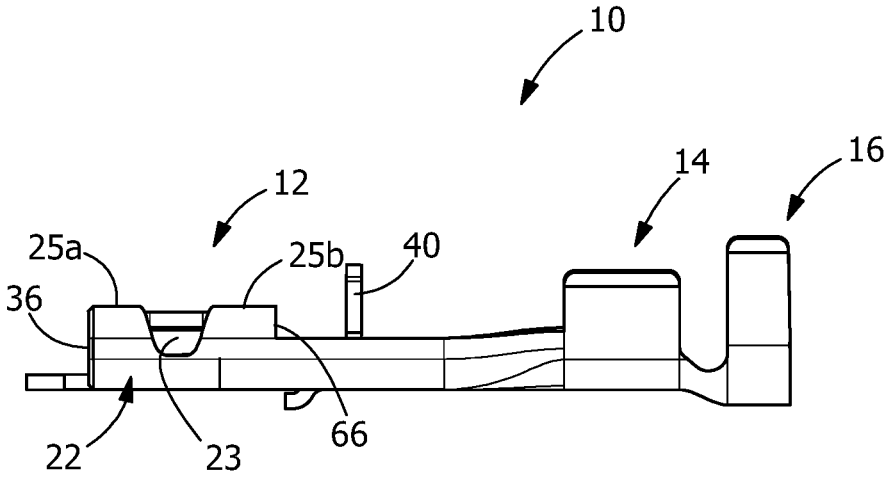
FIG. 3 is a side view of the terminal of FIG. 1.
Figure 4:
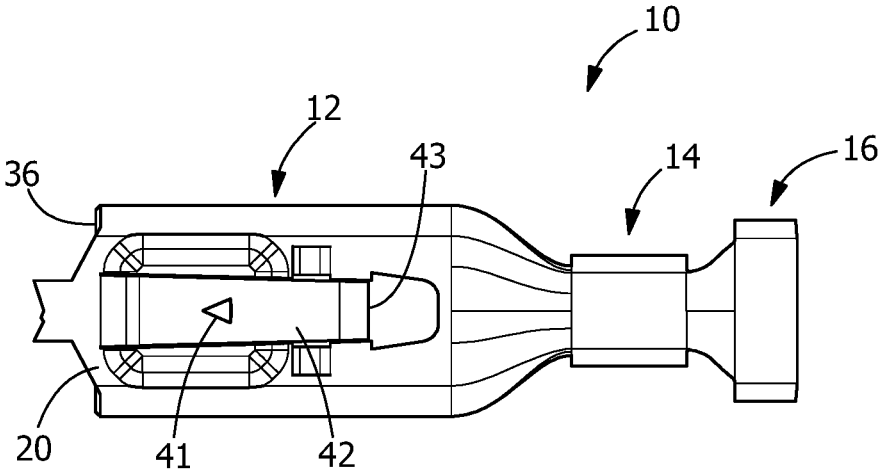
FIG. 4 is a bottom view of the terminal of FIG. 1.

As best shown in FIGS. 1, 2 and 5, mating terminal engagement member 50*a* of a respective resilient contact arm 22 has an end surface 51*a* which is spaced from the resilient contact sections 25*a*, 25*b* of the opposite respective contact arm 22. Mating terminal engagement member 50*b* of a respective resilient contact arm 22 has an end surface 51*b* which is spaced from the resilient contact sections 25*a*, 25*b* of the opposite respective contact arm 22. The end surfaces 51*a* and 51*b* are positioned proximate to each other, but are spaced apart to form a slot 53. The width of the slot 53 is large enough to allow the end surfaces 51*a* and 51*b* and their respective contact arms 22 to move independently of each other. However, the width of the slot 53 is minimized to increase the beam length of the spring arms 42. The increased beam length allows the spring arms 42 to have enhanced resilient or spring characteristics, allowing the respective contact arms 22 to move without taking a permanent set, failing or yielding. The beam length of each of the spring arms 42 of the illustrative embodiment is measured from the edge of the bottom wall 20, across the resilient contact sections 25, across the mating terminal engagement member 50, to the end surface 51 of the mating terminal engagement member 50.

The end surface 51*a* has a recess or cut out 55*a* which extends from the end surface 51*a* toward the opening 23 and the resilient contact sections 25*a*, 25*b* of the respective resilient contact arm 22. Similarly, the end surface 51*b* has a recess or cut out 55*b* which extends from the end surface 51*b* toward the opening 23 of the respective resilient contact arm 22. The recess or cut out 55*a* is aligned with the recess or cut out 55*b*, as best shown in FIG. 2. The recess or cut out 55*a* and the recess or cut out 55*b* combine to form a projection receiving opening 57 which is dimensioned to receive the projection or lance 41 of the spring arm 42 therein, as will be more fully described below.

In the illustrative embodiment shown, the spring arm 42 is stamped and formed from the bottom wall 20. The spring arm 42 is formed to allow a free end 43 thereof to move or be resiliently deformed relative to the bottom wall 20, allowing the spring arm 42 to move toward and away from the mating terminal engaging member 50.

In the initial, unstressed position, prior to the insertion of the mating terminal, the spring arm 42 is positioned proximate to, but not in engagement with, the mating terminal engagement members 50. As the contact portion 12 of the terminal 10 must be able to accept and retain mating terminals which are thin, the spring arms 42 must be positioned proximate to the mating terminal engagement members 50. In order to allow for spring arm 42 to be properly positioned, the lance or projection 41 of the spring arm 42 is positioned in the opening formed by the recess or cut out 55*a* and the recess or cut out 55*b*. This allows the spring arm 42 and lance or projection 41 to be properly positioned without making mechanical or electrical contact with the mating terminal engagement members 50 when no mating terminal is inserted into the contact portion 12 of the terminal 10.

In the illustrative embodiment shown, at its closest point, when the terminal 10 is in the unstressed position prior to receipt of the mating terminal, the spring arm 42 is spaced from the mating terminal engagement members 50 by a distance of between approximately 0.02 inches to 0.032 inches. This allows a mating terminal of similar thickness to be inserted therein. In this position, the lance or projection 41 extends into the projection receiving opening 57, however, the lance or projections 41 does not contact the walls of the projection receiving opening 57.

In the illustrative embodiment shown, the spring arm 42 has an end wall 40 provided thereon. The end wall 40 extends from the spring arm 42 to create a stop portion which extends from the inner surface of the spring arm 42 toward the mating terminal engaging member 50. The end wall 40 is provided to limit the distance the mating terminal can be inserted into the slot 46.

The configuration of the resilient contact arms 22 and the spring arm 42 allows the contact portion 12 to compensate for any slight misalignment of the mating terminal or any slight warpage or imperfections associated with the mating terminal.

A terminal according to the teaching of the invention has a lower spring rate than known terminals. As the beam length of the spring arms 42 is maximized, the spring rate of the spring arms can be reduced while still providing sufficient normal force to retain the mating terminal or tab in the mating slot 46 of the contact portion 12 of the terminal 10. The spring rate of the spring arms 42 is also affected by controlling the space and size of the contact sections 25*a*, 25*b* and the openings 23.

By controlling the spring rate of the spring arms 42, the normal forces and insertion forces associated with the contact portion 12 of the terminal 10 can be also be controlled, while allowing for a proper electrical connection between the terminals 10 and the mating terminals. For example, the insertion force of a terminal made according to the present invention may be reduced in comparison to a terminal without individual contact sections 25*a*, 25*b* separated by openings 23.

As the spring rate is reduced, the resilient arms 22 allow for a greater spring deflection before yielding or taking a permanent set. This allows the terminal to be used with mating terminals which have some variance in manufacturing tolerances. In other words, because the resilient arms 22 have the ability to deflect a greater distance without yielding or taking a permanent set, the thickness of the mating terminal does not have be as precisely controlled. This is advantageous with terminals made of materials, such as steel, which do not exhibit generally poor spring characteristics.

In a fully inserted position, the lance or projection 41 of the spring arm 42 and the mating terminal engagement surfaces 52 are all provided in electrical and mechanical contact with the mating terminal. The multiple areas of contact allow the terminal 10 to be used in applications with higher current levels, such as, but not limited to, 15 to 20 or more amps. The configuration of the spring arm 42 and mating terminal engagement surfaces 52 provide a stable and reliable electrical connection between the mating terminal and the terminal 10. The configuration of the lance or projection 41 of the spring arm 42 and mating terminal engagement surfaces 52 provide for higher hertzian stresses, thereby eliminating or minimizing the fretting corrosion between the terminal 10 and the mating terminal, thereby providing a stable and reliable electrical connection between the mating terminal and the terminal 10.

As portions of the mating terminal engagement surfaces 52 are spaced from and are laterally offset from the lance or projection 41, the connection between the mating terminal and the mating terminal engagement surfaces 52 and the lance or projection 41 of the receptacle terminal 10 are dispersed, i.e. not at one point or in a straight line, providing a stable mechanical and electrical engagement between the mating terminal and receptacle terminal 10 in all environments, thereby insuring that the mating terminal will remain properly positioned in the receptacle terminal 10 as vibration occurs.

As the lance or projection 41 of the spring arm 42 and portions of the mating terminal engagement surfaces 52 are laterally offset from each other, the receptacle terminal 10 provides multiple contact areas even if the mating terminal is bent. In addition, the multiple contact areas resist twisting or misalignment of the mating terminal.

In one embodiment, the resilient arms 22 and are configured such that the contact areas of the mating terminal engagement surfaces 52 generate an equal and opposite force to resist the force generated by the lance or projection 41 of the spring arm 42. In addition, the resilient arms 22 and are configured such that the contact areas of the lance or projection 41 of the spring arm 42 generate an equal and opposite force to resist the force generated by the mating terminal engagement surfaces 52. However, the configuration of the resilient arms 22 may be varied to allow the contact areas to have varied forces associated therewith. In particular, the positioning of the lance or projection 41 of the spring arm 42 can alter the force applied by each contact area.

The configuration of the resilient contact arms 22 and the spring arm 42, including the beam length and the use of multiple contact areas, allow for a lower normal force during mating and unmating of the mating terminal from the terminal 10. This allows the mating terminal and terminal 10 to be more durable over numerous cycles, as there is less plating wear due to the lower mating or normal forces. The number of contact areas also allows the terminal 10 to be used at higher current levels, as the number of contact areas allows the extreme heat associated with the high current levels to be dispersed, thereby preventing welding of the contact asperities.

The terminal of the present invention has resilient contact arms which have a reduced contact spring rate, thereby preventing the terminal from yielding or taking a permanent set. The reduced contact spring rate also allows the contact normal force to be more accurately controlled with the same manufacturing tolerances. More controlled normal force allows for a minimum contact normal force to be reliably maintained while reducing the insertion force required during mating. The resilient contact arms provide a stable electrical connection while allowing for a lower insertion force of the mating terminal into the socket terminal.

While the invention has been described with reference to a preferred embodiment, it will be understood by those skilled in the art that various changes may be made and equivalents may be substituted for elements thereof without departing from the spirit and scope of the invention of the invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. A receptacle terminal for receipt of a mating terminal therein, the receptacle terminal having a contact portion comprising:

a bottom wall;

resilient contact arms extending from the bottom wall;

the resilient contact arms having resilient contact sections and mating terminal engagement members, the mating terminal engagement members forming a projection receiving opening;

a spring arm extending from the bottom wall toward the mating terminal engagement members, the spring arm having a projection which extends from the spring arm to create a raised area on an inner surface of the spring arm to engage the mating terminal;

wherein prior to the receipt of the mating terminal, the projection of the spring arm is positioned in the projection receiving opening of the mating terminal engagement members, allowing the portions of the spring arm to be positioned proximate the mating terminal engagement members.

2. The terminal as recited in claim 1, wherein each respective mating terminal engagement member of the mating terminal engagement members of each respective resilient contact arm of the resilient contact arms has an end surface which is spaced from the resilient contact section of the respective resilient contact arm, the end surfaces of the resilient contact arms are positioned proximate to each other, but are spaced apart to form a slot, the width of the slot being large enough to allow the end surfaces to move independently of each other, the width of the slot being minimized to increase the beam length of the spring arms, wherein the increased beam length allows the spring arms to move without taking a permanent set, failing or yielding.

3. The terminal as recited in claim 2, wherein the end surfaces have recesses which extend from the end surfaces toward respective resilient contact sections of the resilient contact arms, the recesses are aligned to form the projection receiving opening.

4. The terminal as recited in claim 1, wherein prior to receipt of the mating terminal in the terminal, the projection and the spring arm are not provided in mechanical or electrical contact with the mating terminal engagement members and the spring arm is spaced from the mating terminal engagement members by a distance of between approximately 0.02 inches to 0.032 inches.

5. The terminal as recited in claim 1, wherein the mating terminal engagement surfaces have an arcuate configuration.

6. The terminal as recited in claim 1, wherein the mating terminal engaging members have lead-in surfaces provided to help guide the mating terminal into the receptacle terminal.

7. The terminal as recited in claim 1, wherein the mating terminal engaging members extend from the resilient contact sections toward the bottom wall, mating terminal engagement surfaces of the mating terminal engaging members are positioned at a top of a mating slot of the receptacle terminal.

8. The terminal as recited in claim 1, wherein openings extend through the resilient contact arms, with first resilient contact sections of the resilient contact sections and second resilient contact section of the resilient contact sections extending on either side of the openings, the first resilient contact sections and the second resilient contact sections having arcuate portions which extend from the bottom wall to mating terminal engaging members.

9. The terminal as recited in claim 8, wherein at least one of the first resilient contact sections and the second resilient contact sections have a width proximate the bottom wall which is greater than a width of proximate the mating terminal engaging member, wherein the width proximate the bottom wall distribute forces to the bottom wall.

10. The terminal as recited in claim 9, wherein the first resilient contact sections and the second resilient contact sections have different sizes.

11. A receptacle terminal for receipt of a mating terminal therein, the receptacle terminal comprising:

a bottom wall;

resilient contact arms extending from opposed sides of the bottom wall;

the resilient contact arms having resilient contact sections and mating terminal engagement members, end surface of the mating terminal engagement members having recesses which extend from the end surfaces toward respective resilient contact sections of the resilient contact arms, the recesses are aligned to form a projection receiving opening;

a spring arm extending from the bottom wall toward the mating terminal engagement members, the spring arm having a projection which extends from the spring arm to create a raised area on an inner surface of the spring arm to engage the mating terminal;

wherein prior to the receipt of the mating terminal, the projection of the spring arm is positioned in the projection receiving opening of the mating terminal engagement members, allowing the portions of the spring arm to be positioned proximate the mating terminal engagement members.

12. The terminal as recited in claim 11, wherein the end surfaces of the resilient contact arms are positioned proximate to each other, but are spaced apart to form a slot, the width of the slot being large enough to allow the end surfaces to move independently of each other, the width of the slot being minimized to increase the beam length of the spring arms, wherein the increased beam length allows the spring arms to move without taking a permanent set, failing or yielding.

13. The terminal as recited in claim 12, wherein prior to receipt of the mating terminal in the terminal, the spring arm is spaced from the mating terminal engagement members by a distance of between approximately 0.02 inches to 0.032 inches.

14. The terminal as recited in claim 12, wherein the mating terminal engagement surfaces have an arcuate configuration.

15. The terminal as recited in claim 12, wherein the mating terminal engaging members have lead-in surfaces provided to help guide the mating terminal into the receptacle terminal.

16. The terminal as recited in claim 12, wherein the mating terminal engaging members extend from the resilient contact sections toward the bottom wall, mating terminal engagement surfaces of the mating terminal engaging members are positioned at a top of a mating slot of the receptacle terminal.

17. The terminal as recited in claim 12, wherein openings extend through the resilient contact arms, with first resilient contact sections of the resilient contact sections and second resilient contact section of the resilient contact sections extending on either side of the openings, the first resilient contact sections and the second resilient contact sections having arcuate portions which extend from the bottom wall to mating terminal engaging members.

18. The terminal as recited in claim 17, wherein at least one of the first resilient contact sections and the second resilient contact sections have a width proximate the bottom wall which is greater than a width of proximate the mating terminal engaging member, wherein the width proximate the bottom wall distribute forces to the bottom wall.

19. The terminal as recited in claim 18, wherein the first resilient contact sections and the second resilient contact sections have different sizes.

20. A receptacle terminal for receipt of a mating terminal therein, the receptacle terminal comprising:

a bottom wall;

resilient contact arms extending from opposed sides of the bottom wall;

the resilient contact arms having resilient contact sections and mating terminal engagement members;

openings extend through the resilient contact arms, with first resilient contact sections of the resilient contact sections and second resilient contact section of the resilient contact sections extending on either side of the openings;

end surface of the mating terminal engagement members having recesses which extend from the end surfaces toward respective resilient contact sections of the resilient contact arms, the recesses are aligned to form a projection receiving opening, the mating terminal engaging members extending from the resilient contact sections toward the bottom wall, mating terminal engagement surfaces of the mating terminal engaging members are positioned at a top of a mating slot of the receptacle terminal;

a spring arm extending from the bottom wall toward the mating terminal engagement members, the spring arm having a projection which extends from the spring arm to create a raised area on an inner surface of the spring arm to engage the mating terminal;

wherein prior to the receipt of the mating terminal, the projection of the spring arm is positioned in the projection receiving opening of the mating terminal engagement members, allowing the portions of the spring arm to be positioned proximate the mating terminal engagement members.

* * * * *